US005117150A

United States Patent [19]

Schwarz et al.

[11] Patent Number: 5,117,150

[45] Date of Patent: May 26, 1992

[54] INTERFERENCE FILTER FOR DEUTERIUM LAMP FOR SPECTRAL ANALYZERS

[75] Inventors: Werner Schwarz, Gelnhausen; Horst Kremmling, Limeshain; Günter Thomas, Erlensee; Hans-Georg Lotz, Gründau, all of Fed. Rep. of Germany

[73] Assignee: Heraeus Instr. GmbH & Leybold AG, Hanau, Fed. Rep. of Germany

[21] Appl. No.: 572,962

[22] PCT Filed: Jan. 20, 1990

[86] PCT No.: PCT/EP90/00114

§ 371 Date: Sep. 10, 1990

§ 102(e) Date: Sep. 10, 1990

[87] PCT Pub. No.: WO90/09032

PCT Pub. Date: Aug. 9, 1990

[30] Foreign Application Priority Data

Jan. 25, 1989 [DE] Fed. Rep. of Germany ..... 3902144

[51] Int. Cl.[5] ..... H01J 61/40

[52] U.S. Cl. ..... 313/112; 313/635; 313/637; 359/359; 359/580

[58] Field of Search ..... 313/112, 635, 637; 350/1.6, 1.7

[56] References Cited

U.S. PATENT DOCUMENTS

| | | | |
|---|---|---|---|
| 3,914,023 | 10/1975 | Thelen | 350/164 |
| 3,931,536 | 1/1976 | Morris et al. | 313/113 |
| 4,049,987 | 9/1977 | Helms et al. | 313/112 |
| 4,320,936 | 3/1982 | Sawamura et al. | 350/1.6 |
| 4,880,988 | 11/1989 | Witt et al. | 250/504 R |
| 4,910,431 | 3/1990 | Witt et al. | 313/589 |

FOREIGN PATENT DOCUMENTS

| | | |
|---|---|---|
| 1589095 | 3/1970 | Fed. Rep. of Germany . |
| 2530195 | 2/1976 | Fed. Rep. of Germany . |
| 02897706 | 10/1988 | Fed. Rep. of Germany . |
| 1353566 | 1/1964 | France . |
| 8502966 | 10/1986 | Netherlands . |

OTHER PUBLICATIONS

E. T. Fairchild, "Interference Filters for the VUV (1200–1900 Å", *Applied Optics*, vol 12, No. 10, pp. 2240–2241, Oct. 73.

Original Hanau Quarzlampen GmbH, datasheet entitled "Deuterium-Lampe D60 & D60F", Sep. 1973.

W. C. Heraeus GmbH, Original Hanau Division, datasheet entitled "Deuteriumlampen-Baureihe D800/900" (undated).

*Primary Examiner*—Donald J. Yusko
*Assistant Examiner*—Diab Hamadi
*Attorney, Agent, or Firm*—Frishauf, Holtz, Goodman & Woodward

[57] ABSTRACT

A deuterium lamp with a quartz glass bulb for spectral analyzers is disclosed. At least the portion of the quartz glass bulb through which the radiation produced passes is provided on its outer surface with a multiple interference filter layer; the physical layer thickness of each layer is in the range from 10 to 70 nm. The multiple layer comprises atlternating aluminum oxide and silicon dioxide, or magnesium fluoride. The interference filter layers are preferably vapor-deposited in a vacuum.

6 Claims, 2 Drawing Sheets

INTERFERENCE FILTER FOR DEUTERIUM LAMP FOR SPECTRAL ANALYZERS

The invention relates to a deuterium lamp with a discharge bulb of quartz glass for spectral analyzers, in particular spectral photometers, in which the radiation produced passes through a portion of the bulb.

BACKGROUND OF THE INVENTION

Deuterium lamps of the type defined above are known for instance from the W. C. Heraeus GmbH brochure entitled "Deuteriumlampen—Baureihe D 800/900" [Deuterium Lamps—Series D 800/900](D 310 686/2C 7.86/VN Ko). These deuterium lamps furnish a continuous, line-free spectrum in the ultraviolet spectral range between 160 and 360 nm. They are used particularly in photometry equipment, preferably spectral analyzers. The bulb of these deuterium lamps is of quartz glass, and if synthetic quartz glass is used, the lamp bulb becomes transparent for wavelengths of up to approximately 160 nm. Deuterium lamps of this previously known type have proved to be excellent in operation. They are distinguished by a long service life and particularly high radiation stability. However, it has been found that the radiation noise of the lamp is a limiting factor when these lamps are used for detecting very slight concentrations. The known deuterium lamps have a radiation noise level of approximately $2\times10^{-4}$ AU (AU=absorption units).

SUMMARY OF THE INVENTION

It is the object of the present invention to further reduce the radiation noise level of the deuterium lamps defined at the outset above, while retaining the aforementioned favorable properties of the known deuterium lamps.

For deuterium lamps of the type defined at the outset above, this object is attained in accordance with the invention in that at least the aforementioned portion of the bulb has on its surface a multiple interference filter layer of alternating aluminum oxide and either silicon dioxide or magnesium fluoride; the physical thickness of each layer is in the range from 10 to 70 nm, and the first effective layer of the interference filter, facing the bulb surface, comprises aluminum oxide, and the multiple interference filter layer has an absorption edge at a wavelength from approximately 190 to 200 nm, but has maximally high transmission for wavelengths greater than 200 nm. In the deuterium lamps according to the invention, it has proved successful to provide at least 10 pairs of layers for the multiple interference filter layer. The term "pair of layers" is understood to mean a combination of one aluminum oxide layer and one layer of either silicon dioxide or magnesium fluoride. According to the invention, the multiple interference filter layer has a steep absorption edge in the wavelength range from approximately 190 to 200 nm.

By embodying the deuterium lamp according to the invention, the radiation noise level can be reduced by over 50%, at least. If the number of pairs of layers is increased, a reduction by approximately one order of magnitude was even attainable; that is, it was possible to lower the radiation noise level to a value of $2\times10^{-5}$ AU The deuterium lamps provided with interference filters embodied in accordance with the invention are distinguished not only by the steep absorption edge in the range from 190 to 200 nm, but also by the fact that at a wavelength greater than 200 nm, they have an extraordinarily high transmission for the longer-wave UV radiation, or in other words precisely the radiation that one seeks to use for performing spectral analysis tests. In terms of their service life, the lamps according to the invention have not changed, compared with deuterium lamps without a multiple interference filter layer; nor has the transmission of UV radiation at a wavelength of greater than 200 nm undergone any disadvantageous change, even when operated for periods of over 1500 hours. Another advantage of the deuterium lamps according to the invention that should be stressed is that ozone formation, which not only impedes spectral analysis but may also harm persons working with it, does not take place.

Interference filter layer combinations of aluminum oxide and silicon dioxide have proved particularly successful. With these layer combinations, the uppermost layer, facing away from the surface of the quartz glass bulb, of the interference filter is of silicon dioxide.

However, if an interference filter layer combination of aluminum oxide and magnesium fluoride is used, then it is recommended that the uppermost layer, facing away from the surface of the quartz glass bulb, of the interference filter be produced from aluminum oxide.

In the deuterium lamps according to the invention, the multiple interference filter layers are in particular layers that are vapor-deposited in a vacuum. However, this does not preclude the possibility of using other interference filter layers applied in a usual manner, instead of vapor-deposited layers.

The thickness of each layer of the interference filter is lambda/4, where lambda is the limit wavelength of the absorption edge, which is at approximately 190 nm.

DETAILED DESCRIPTION OF THE PREFERRED EMBODIMENT

Figure 1:
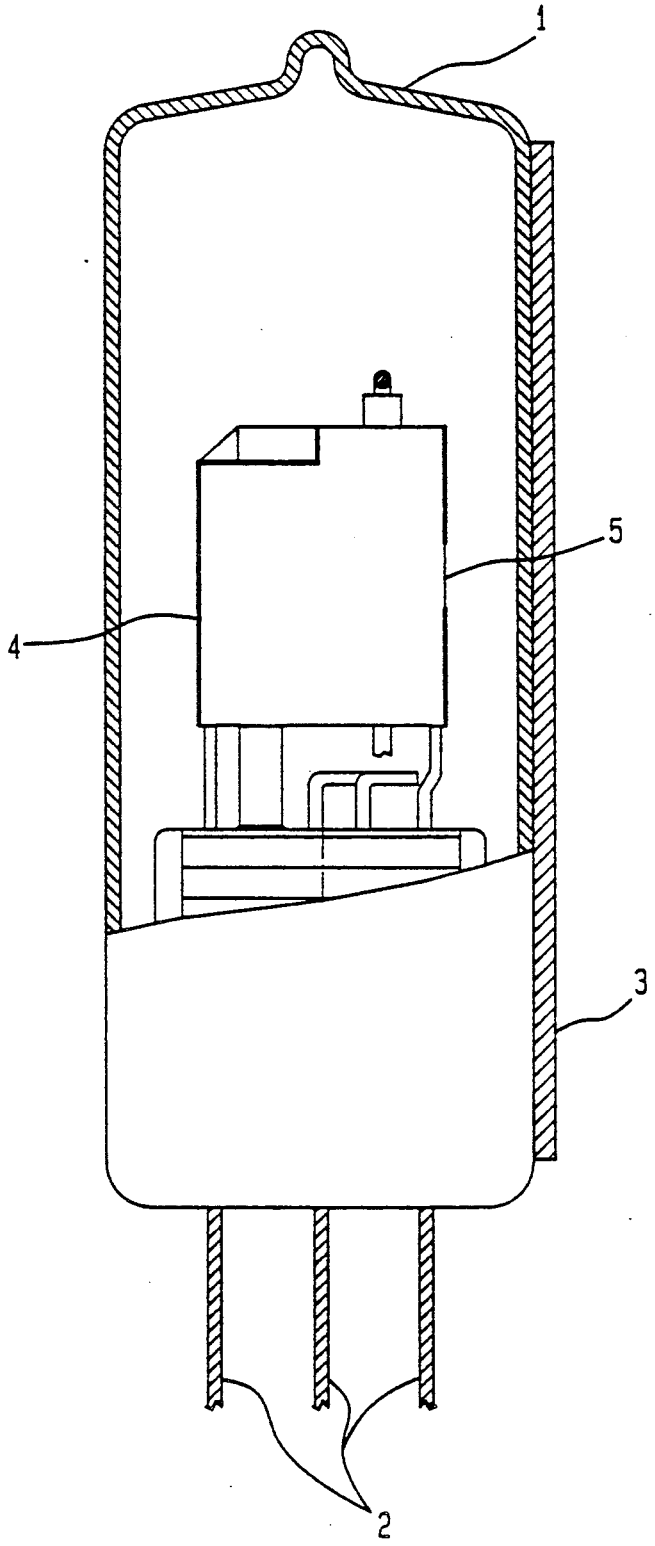
FIG. 1 illustrates a perspective view of a deuteurium lamp bulb according to the present invention.

A deuterium lamp embodied in accordance with the invention and shown schematically will now be described, in conjunction with FIG. 1.

Reference numeral 1 represents the quartz glass bulb, which contains deuterium and to the surface of which the filter 3, comprising a multiple interference layer, is applied. Electric current is supplied to the deuterium lamp via the power leads 2. The cathode and anode of the deuterium lamp are disposed in the metal housing 4. The radiation produced passes first through the opening 5 in the housing 4 and then passes through the quartz glass bulb 1 and filter 3.

Figure 2:
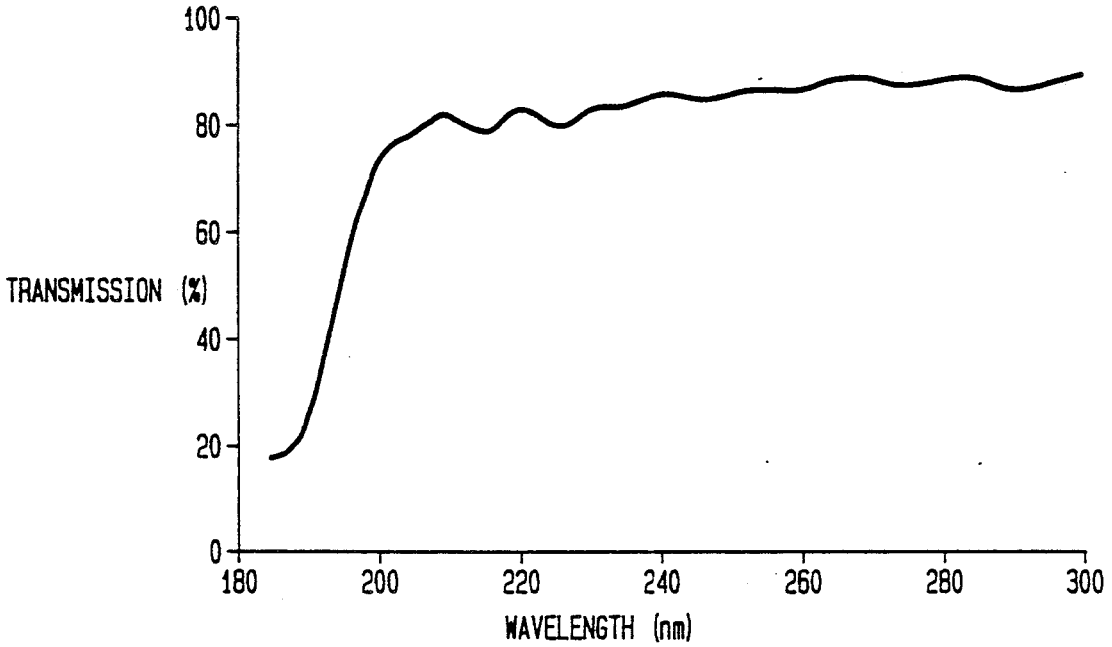
FIG. 2 shows a transmission curve of deuterium lamp bulb with a multiple interference layer applied in accordance with the present invention.

FIG. 2, shows a transmission curve of a deuterium lamp bulb with a multiple interference layer applied in accordance with the invention; the wavelength is plotted on the abscissa, in nanometers, and the transmission is plotted on the ordinate, in percent. The transmission curve clearly shows that the deuterium lamp provided with the multiple interference filter layer has a steep absorption edge in the range from 190 to 200 nm, and that for UV wavelengths greater than 200 nm, the transmission increases to values in the range from 80 to 90% and maintained there.

The application of the multiple interference filter layer to the quartz glass lamp bulb is performed for instance as described below.

In a vacuum vapor deposition system of the type A1100Q (made by Leybold AG, Hanau, Federal Republic of Germany), the succession of layers listed in the table hereinafter, having a total of 40 individual layers, was produced on a quartz glass lamp bulb. The tubular quartz glass lamp bulb, having a diameter of 30 mm, was clamped in a dome-shaped holder that rotated above the vaporizer sources at a distance of approximately 50 cm. During the coating, the quartz glass bulb was heated to a temperature of 300° C. by a radiant heater. The coating materials, silicon dioxide on the one hand and aluminum oxide on the other, were vaporized in alternation from two electron beam guns (type ESV14).

The vapor deposition system was evacuated to a pressure of $5\times10^{-4}$ Pa within 30 minutes. After a heating time of one hour, the quartz glass bulb was pretreated in an argon atmosphere, at a pressure of 5 pa within 10 minutes, in a glow discharge. Next, at an oxygen partial pressure of $2\times10^{-2}$ Pa, the layers of silicon dioxide and aluminum dioxide were vapor-deposited in alternating order and with the layer thicknesses given (see the table).

The layer buildup and control of the vaporizer sources were effected by means of an optical layer thickness measuring instrument of a known type.

The quartz glass bulb produced in this way had a transmission in the spectral range above 200 nm that at maximum exceeded 90%; at the same time, the transmission under 200 nm was less than 20%.

TABLE

| Layer No. | Layer Material | Optical Thickness | Physical Thickness (approx.) |
|---|---|---|---|
| 40. | $SiO_2$ = | 383 nm | 64 nm |
| 39. | $Al_2O_3$ = | 92 nm | 14 nm |
| 38. | $SiO_2$ = | 180 nm | 30 nm |
| 37. | $Al_2O_3$ = | 180 nm | 27 nm |
| 36. | $SiO_2$ = | 180 nm | 30 nm |
| 35. | $Al_2O_3$ = | 180 nm | 27 nm |
| . | . | . | . |
| . | . | . | . |
| . | . | . | . |
| 3. | $Al_2O_3$ = | 180 nm | 27 nm |
| 2. | $SiO_2$ = | 92 nm | 15 nm |

TABLE-continued

| Layer No. | Layer Material | Optical Thickness | Physical Thickness (approx.) |
|---|---|---|---|
| 1. | $Al_2O_3$ = | 199 nm | 30 nm |

Quartz glass bulb

It should also be noted that both the second layer of the interference filter (layer number 2 in the table) and the (n−1) th layer (the 39th layer in the table) are so-called adaption layers, intended to reduce the waviness of the transmission curves.

We claim:

1. A deuterium lamp with a quartz discharge bulb for spectral analyzers, in particular spectral photometers, in which the radiation produced passes through a portion of the bulb, characterized in that at least that portion of the bulb through which said radiation passes has, on its outer surface, a multiple interference filter layer of alternating aluminum oxide and either silicon dioxide or magnesium fluoride, wherein the physical layer thickness of each layer is in the range from 10 to 70 nms and the first effective layer of the interference filter, facing the bulb surface, comprises aluminum oxide, and the multiple interference filter layer has an absorption edge at a wavelength from approximately 190 to 200 nm, but has maximally high transmission for wavelengths greater than 200 nm.

2. The deuterium lamp of claim 1, characterized in that the multiple interference filter layer comprises at least 10 pairs of layers, wherein one pair of layers comprises one aluminum oxide layer and one layer comprises either silicon dioxide or magnesium fluoride.

3. The deuterium lamp of claim 1, characterized in that the case where the interference filter layer combination is aluminum oxide and silicon dioxide, the uppermost layer of the interference filter, facing away from the surface of the quartz glass bulb, comprises silicon dioxide.

4. The deuterium lamp of claim 1, characterized in that the case where the interference filter layer combination is aluminum oxide and magnesium fluoride, the uppermost layer of the interference filter, facing away from the surface of the quartz glass bulb, comprises aluminum oxide.

5. The deuterium lamp of claim 1, characterized in that the interference filter layers are layers that are vapor-deposited i a vacuum.

6. The deuterium lamp of claim 1, characterized in that the thickness of each layer of the interference filter is lambda/4, where lambda equals limit wavelength of the absorption edge.

* * * * *